US005403101A

United States Patent [19]

Nagase et al.

[11] Patent Number: 5,403,101

[45] Date of Patent: Apr. 4, 1995

[54] TAPE PRINTER HAVING LINE ENHANCEMENT CAPABILITY

[75] Inventors: Sachiyo Nagase, Nishikasugai; Shoji Sakuragi; Hideo Ueno, both of Nagoya, all of Japan

[73] Assignee: Brother Kogyo Kabushiki Kaisha, Nagoya, Japan

[21] Appl. No.: 1,755

[22] Filed: Jan. 7, 1993

[30] Foreign Application Priority Data

Jan. 7, 1992 [JP] Japan ..... 4-018508

[51] Int. Cl.[6] ..... B41J 19/64

[52] U.S. Cl. ..... 400/3; 400/615.2; 400/621

[58] Field of Search ..... 400/3, 120, 88, 612, 400/615.2, 621

[56] References Cited

U.S. PATENT DOCUMENTS

| | | | |
|---|---|---|---|
| 4,573,138 | 2/1986 | Gaudet et al. | 400/3 |
| 4,661,001 | 4/1987 | Takai et al. . | |
| 4,783,760 | 11/1988 | Carosso | 400/3 |
| 4,836,712 | 6/1989 | Atsumi . | |
| 5,069,557 | 12/1991 | Kuzuya et al. | 400/120 |
| 5,131,772 | 7/1992 | Yamaguchi | 400/621 |
| 5,188,470 | 2/1993 | Matsubara et al. | 400/621 |
| 5,222,818 | 6/1993 | Akiyama et al. | 400/621 |
| 5,230,572 | 7/1993 | Hirono et al. | 400/3 |

FOREIGN PATENT DOCUMENTS

| | | | |
|---|---|---|---|
| 0029679 | 2/1983 | Japan | 400/615.2 |

*Primary Examiner*—Edgar S. Burr
*Assistant Examiner*—John S. Hilten
*Attorney, Agent, or Firm*—Oliff & Berridge

[57] ABSTRACT

A tape printer includes a thermal head (13) fixedly mounted on a frame (2) wherein the thermal head (13) prints character strings on a tape (5) uni-directionally moving past the thermal head (13). A keyboard (3) is provided for entering characters and data regarding a number of print lines. Character code data corresponding to the entered characters are temporarily stored in line buffer (41), and the thermal head (13 ) prints the character strings in a plurality of lines on the tape (5) based on the character code data and print line number data. Each of the plurality of print lines can be enhanced on a line basis with one of flush left, centering, flush right, and justification. When at least one of the plurality of lines is to be enhanced, the longest character string contained in one line is identified and the rest of the lines are printed in relevant positions referring to the print position of the longest character string.

20 Claims, 13 Drawing Sheets

TAPE PRINTER HAVING LINE ENHANCEMENT CAPABILITY

BACKGROUND OF THE INVENTION

1. Field of the Invention

The present invention relates to a tape printer, and more particularly to a tape printer having line enhancement features such as flush left, flush right, centering, and right justification settable to lines printed on a tape.

2. Description of the Prior Art

There has been proposed a tape printer that prints desired character strings in a dot pattern along a print tape. The tape printer has many practical applications. For example, a tape can be printed with a title or information regarding the contents of a given file and then adhered or affixed to an appropriate position of a casing of the file. The tape printer can also print out a tape with a name and the tape fixed to a name plate.

The tape printer includes a print head fixed to a predetermined position and a rape feed drive for unidirectionally feeding the tape past the print head. The print head has a plurality of printing elements formed in a row or in a direction perpendicular to a direction in which the tape travels. Each element prints a dot on the tape when energized. The tape feed drive feeds the tape past the print head at a speed synchronized with energization of the print elements so the dots printed by the print elements form strings of characters on the tape. The strings of characters form a single line or a plurality of lines.

Conventional tape printers differ from other printing apparatuses, such as typewriters and word processors, in that the print head does not hi-directionally move and the tape is fed in only one direction as mentioned above. Therefore, conventional tape printers cannot print more than one line while enhancing visual appearance of the printed lines, such as flush left and flush right. In view of such a shortage of the Conventional tape printers, a tape printer which can enhance printed lines has been desired, particularly because of the wide availability of printed tapes.

SUMMARY OF THE INVENTION

It is therefore an object of the present invention to provide an improved tape printer which can enhance printed lines when two lines or more are printed on a tape.

To achieve the above and other objects, there is provided a printer which comprises (a) printing means for printing strings of characters on a tape-like print medium, (b) input means for entering commands regarding strings of characters to be printed on the tape-like print medium, the input means producing character code data representative of each character to be printed, (c) storage means for storing the character code data produced from the input means, (d) control means for Controlling the printing means to print the characters in a plurality of lines, (e) mode setting means for setting a line enhancement to each of the plurality of lines on a line basis, the line enhancement being one of flush centering, flush right, and justification, and (f) determining means for determining, when at least one of the plurality of lines is set to the line enhancement by the mode setting means, a string of characters that is longest in length based on the character code data stored in the storage means, wherein the plurality of lines are printed by the printing means so that the enhanced lines are printed while referring to the longest string of characters.

In accordance with another aspect of the invention, there is provided a printer which comprises (a) a frame, (b) means for accommodating a tape-like print medium, (c) means for uni-directionally moving the tape-like print medium, (d) printing means fixedly mounted on the frame for printing strings of characters on the tape-like print medium moving past the printing means, (e) input means for entering commands regarding strings of characters to be printed on the tape-like print medium and a print line number in which the strings of characters are printed, the input means producing character code data representative of each character to be printed and line number data representative of the print line number, (f) storage means for storing the character code data and the line number data both produced from the input means, (g) control means for controlling the printing means to print the characters in a plurality of lines based on the character code data and the line number data, (h) mode setting means for setting a line enhancement to each of the plurality of lines on a line basis, the line enhancement being one of flush left, centering, flush right, and Justification, and (i) determining means for determining, when at least one of the plurality of lines is set to the line enhancement by the mode setting means, a string of characters that is longest in length based on the character code data and the line number data stored in the storage means, wherein the plurality of lines are printed by the printing means so that the enhanced lines are printed while referring to the longest string of characters.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Referring to the accompanying drawings, a preferred embodiment of the invention will be described.

The preferred embodiment is directed to a tape printer which prints alphanumerals, symbols and other characters used in English text. It should be noted that the present invention can also be used for printing other characters such as Japanese kanji, katakana, and hiragana.

Figure 1:
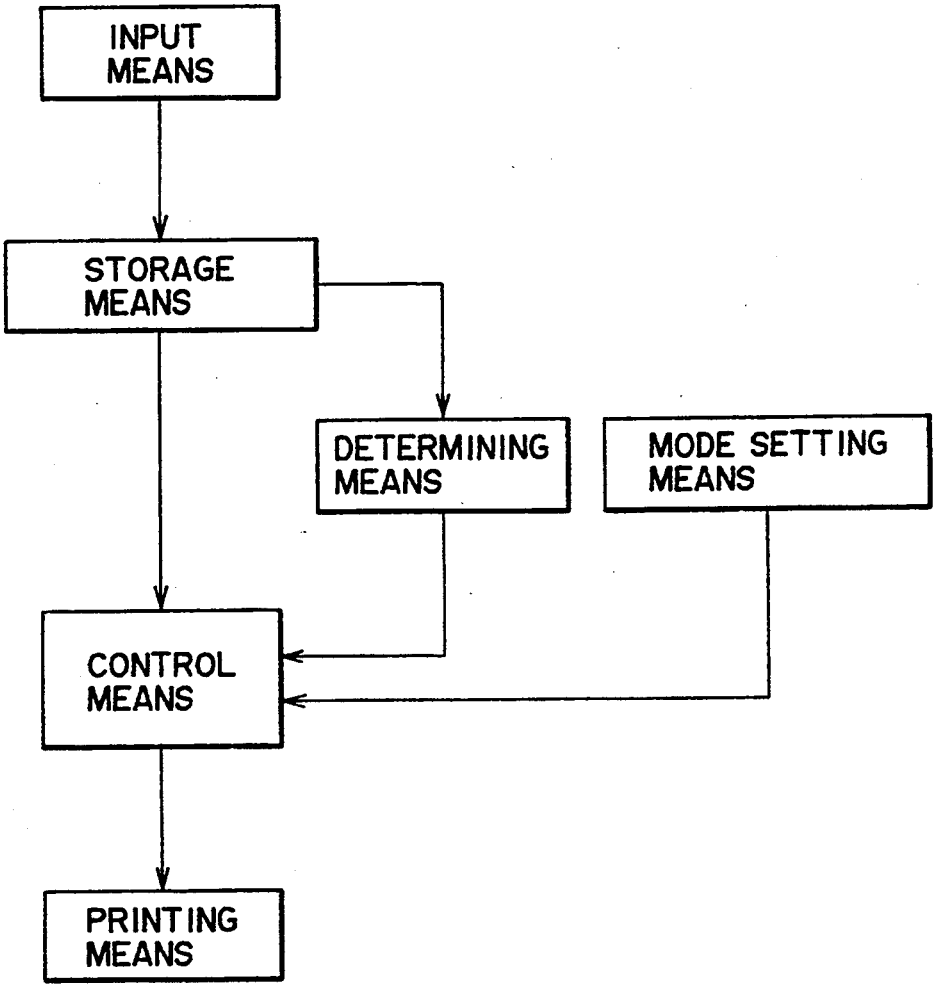
FIG. 1 is a functional block diagram showing a construction of a tape printer according to the present invention.
Figure 2:
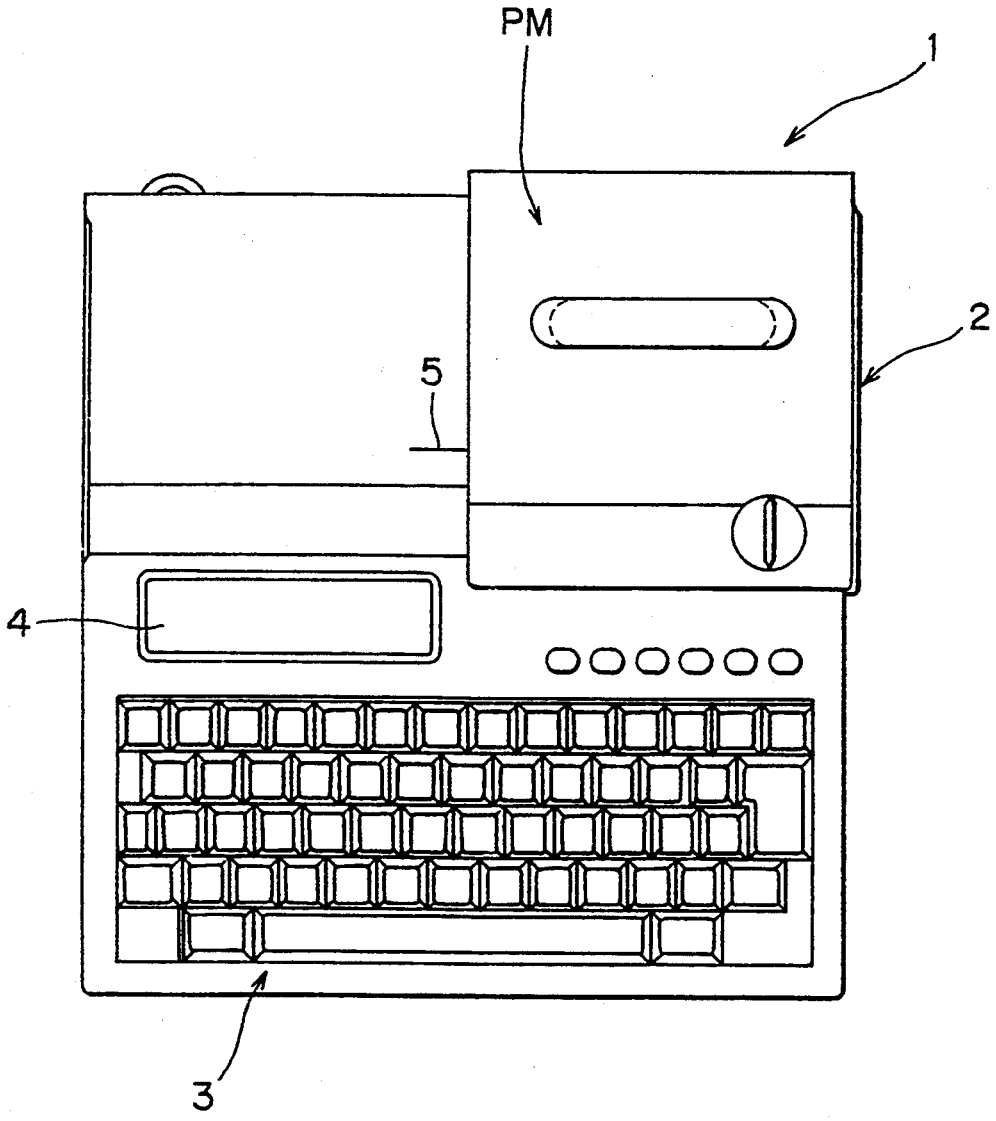
FIG. 2 is a plan view of a tape printer embodying the present invention.

As can be seen in FIG. 2, the tape printer 1 includes a body frame 2 within which is installed a printing mechanism PM. At the front end of the body frame 2 is a keyboard 3. Behind the keyboard 3 is an LCD (liquid crystal display) 4 capable of displaying, for example, up to two lines of characters or symbols.

Figure 3:
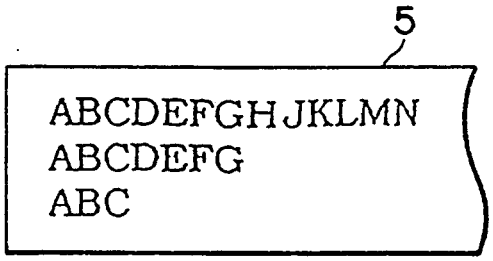
FIG. 3 is a view schematically depicting triple-line character strings printed on a printing tape with a flush left line enhancement feature of the present invention.
Figure 4:
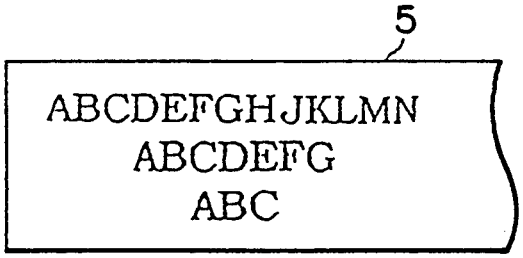
FIG. 4 is a view schematically depicting triple-line character strings printed on a printing tape with a centering line enhancement feature of the present invention.
Figure 5:
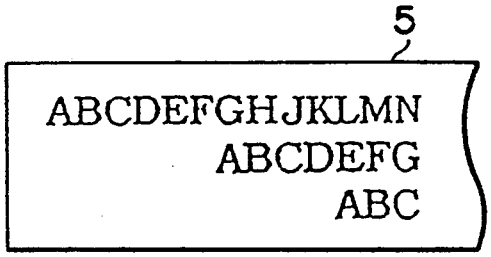
FIG. 5 is a view schematically depicting triple-line character strings printed on a printing tape with a flush right line enhancement feature of the present invention.
Figure 6:
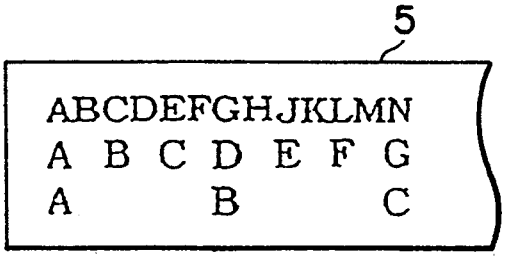
FIG. 6 is a view schematically depicting triple-line character strings printed on a printing tape with a right-justification line enhancement feature of the present invention.

The keyboard 3 includes character keys for entering alphanumerals and symbols, cursor keys for moving a cursor horizontally or vertically across the LCD, a return key for starting a new line of character strings, a text forming key for forming text, a finish key for indicating to the printer when text is complete, a mode set key for setting a line enhancement, a flush left key for making characters flush left as shown in FIG. 3, a centering key for centering characters as Shown in FIG. 4, a flush right key for making characters flush right as Shown in FIG. 5, a right-justification key for aligning characters on the printed lines along a right marginal line as shown in FIG. 6, a printing key for executing printing, and a power switch for turning the power ON and OFF.

Figure 7:
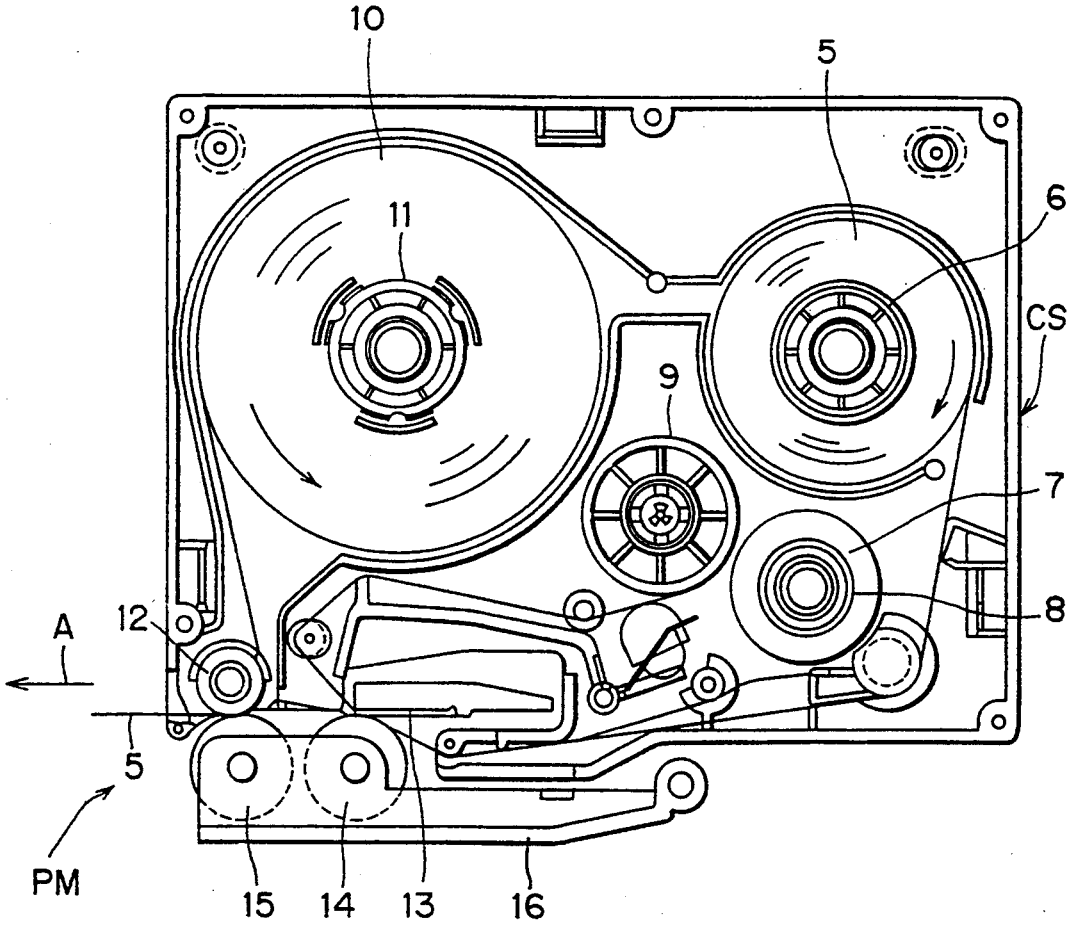
FIG. 7 is a schematic plan view of a printing mechanism in the FIG. 1 tape printer.

Referring to FIG. 7, the printing mechanism PM will now be briefly described. A rectangular tape cassette CS is removably loaded in the body frame 2. The tape cassette CS contains a tape spool 6 around which is wound a printing tape 5 made of transparent film about 24 mm wide, a ribbon feed spool 8 around which an inking ribbon 7 is wound, a take-up spool 9 for taking up used inking ribbon 7, a feed spool 11 around which a double-sided adhesive tape 10 having the same width as the printing tape 5 is wound so its releasable sheet faces outward, and a bonding roller 12 for bonding the printing tape 5 to the double-sided adhesive tape 10. The roller 12 and spools 6, 8, 9, and 11 are all rotatably arranged within the cassette CS.

A thermal head 13 is fixedly located at a position where the printing tape 5 and the inking ribbon 7 overlap each other. A platen roller 14 presses the printing tape 5 and the inking ribbon 7 against the thermal head 13. A feed roller 15 presses the printing tape 5 (which now contains characters) and double-sided adhesive tape 10 against the bonding roller 12. The platen roller 14 and the feed roller 15 are rotatably supported by a supporting member 16. The thermal head 13 contains 128 heating elements 13*a* arranged vertically to extend across the tape width, as shown in FIG. 8.

In operation, the bonding roller 12 and the take-up spool 9 are rotated by a tape feed motor 24 in predetermined directions at speeds in synchronism with each other. The bonding roller 12, the take-up spool 9 and the tape feed motor 24 serve as means for uni-directionally feeding the printing tape 5. In further synchronism with the rotations of the bonding roller 12 and the take-up spool 9, the heating elements 13*a* are selectively energized, causing a plurality of dot columns (dot strings) to be printed on the printing tape 5. The printing tape 5 with the double-sided adhesive tape 10 adhered thereto is fed in the direction of arrow A out of the body frame 2. For a more detailed description of the printing mechanism PM, refer to Japanese Laid-Open Patent Publication No. 2-106555.

Figure 8:
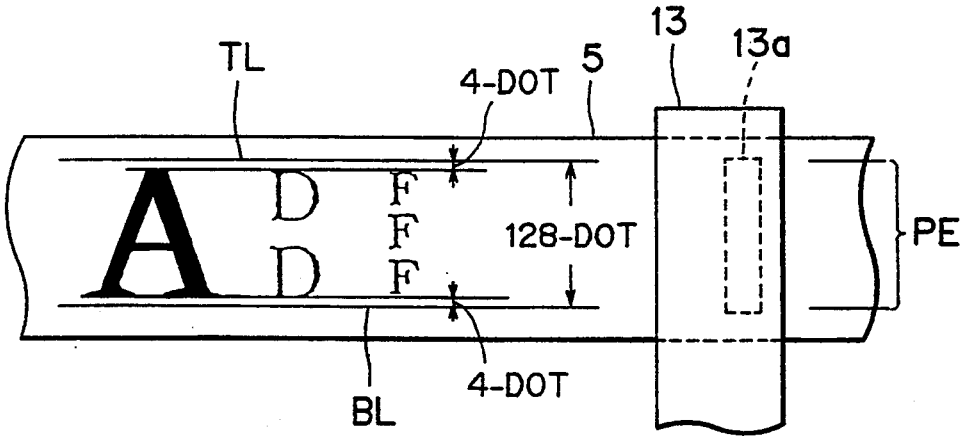
FIG. 8 is a partial front view of the printing mechanism having a thermal head with a printing tape positioned adjacent thereto.

As is shown in FIG. 8, the printing tape 5 is formed with a printing area PE. The printing area corresponds to the vertical length of the hearing elements 13*a* and partially fills the printing tape 5 in the widthwise direction between a top line TL and a bottom line BL. Single-, double-, or, triple-printing of vertical lines, as represented in FIG. 8 by characters "A", "D" and "F" respectively, can be printed within the printing area PE. Single-line printing (i.e., filling the entire printing area PE with a single line), creates large characters (as represented by "A" in FIG. 8) formed by dot pattern data 120 dots high by 120 dots wide. Double-line printing (i.e., dividing the printing area Pe into two equal-sized lines-) creates medium-sized characters (as represented by the two "D" characters in FIG. 8) formed by dot pattern data 48 dots high by 48 dots wide. Triple-line printing (i.e., printing to fill the printing area PE with three equal-sized lines) creates small characters (as represented by the three "F" characters in FIG. 8) formed from dot pattern 32 dots high by 32 dots wide. In triple-line printing, the line nearest the top line TL is called the first line, the line nearest the bottom line BL is the third line, and the line between the first and third lines is the second line. Whether single-line printing, double-line printing, or triple-line printing, a space equivalent to at least a row of four dots separates the uppermost printed area (for example, the upper tip of the single-line printed "A" character) and the top line TL, and a space equivalent to at least a row of four dots separates the lowermost printed area (for example, the base of the single-line printed "A" character) and the bottom line BL.

Figure 9:
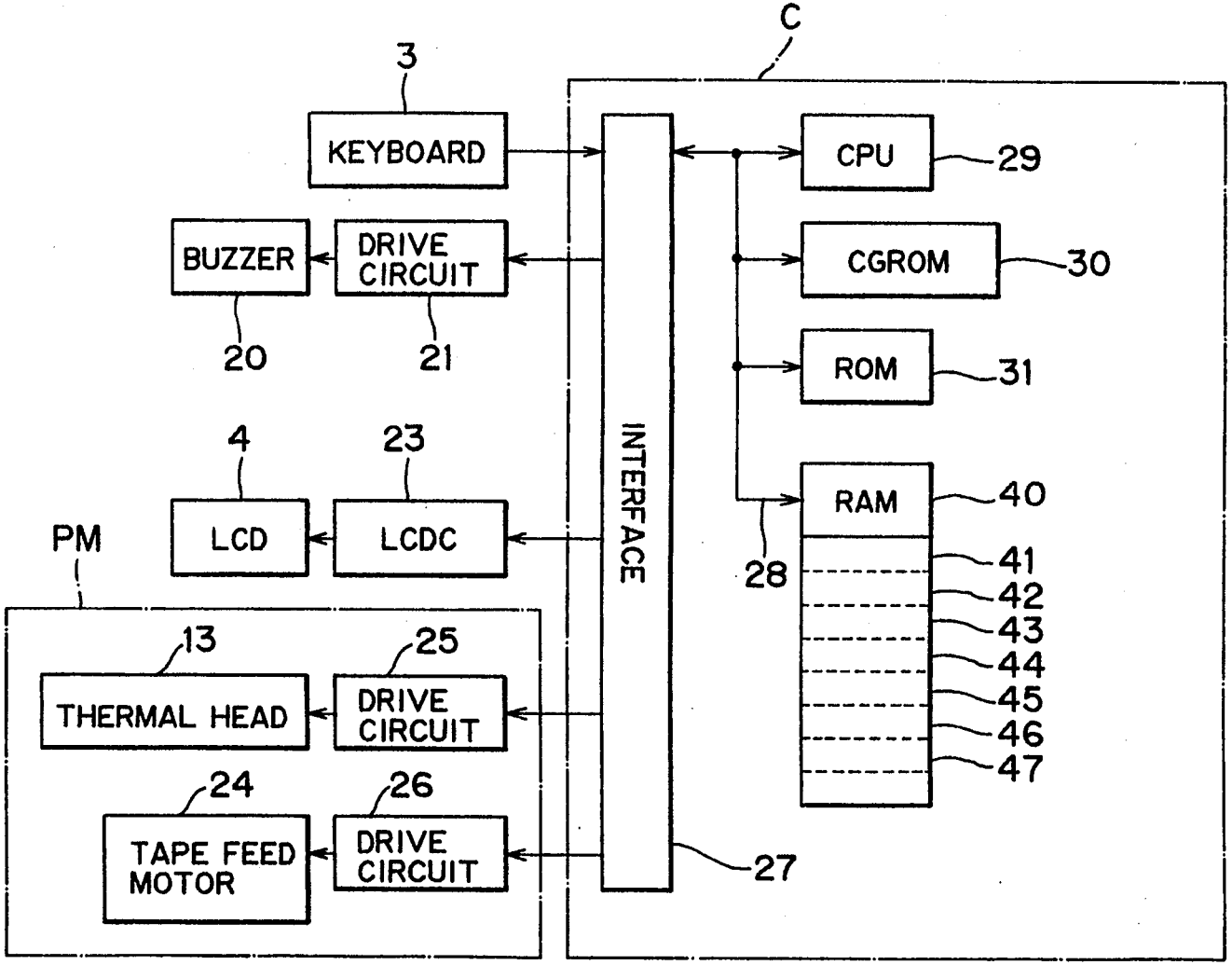
FIG. 9 is a block diagram of a control system for use in the FIG. 1 tape printer.

The control system of the tape printer 1 is constructed as shown in FIG. 9. The control system includes a controller C which is connected via an interface 27 to the keyboard 3, a buzzer drive circuit 21 for driving a buzzer 20, an LCD (liquid crystal display) controller 23 which includes a display RAM for outputting display data to an LCD 4, a thermal head drive circuit 25 for driving the thermal head 13, and a feed motor drive circuit 26 for driving the feed motor 24. The thermal head drive circuit 25 and the feed motor drive circuit 26 are parts of the printing mechanism PM.

The interface 27 of the controller C is connected by a bus 28 (e.g., a data bus) to a CPU (central processing unit) 29, a CGROM (character generating read-only memory) 30, a ROM 31, and a RAM (random access memory) 40, all contained within the controller C. The CGROM 30 stores dot pattern data required for printing each character in the large, medium, or small size, and another dot pattern data for outputing each character to the display RAM of the display controller 23 in association with coding data representative of the character.

Figure 10:
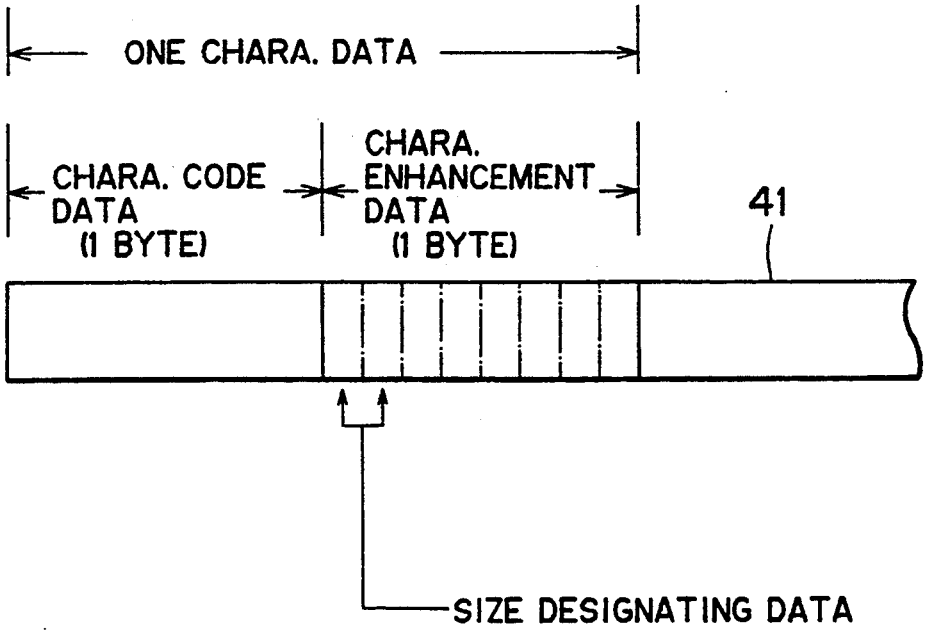
FIG. 10 is a view schematically depicting illustrative data in a line buffer of the present invention.

The ROM 31 stores a table indicating a relationship between the number of lines to be printed and size designating data representative of the size of character to be used for printing, with control programs which include such tape printing control programs as a mode setting control program for setting the specific line enhancements according to the present invention, a data input control program, a display control program, and a tape printing control program. The RAM 40 has a line buffer 41, a text memory 42, a line number memory 43, a flag memory 44, a maximum line length memory 45, a character position memory 46, and a character print buffer 47. As shown in FIG. 10, the line buffer 41 temporarily stores both character code data (1 byte) representative of each character input from the keyboard 3 and character enhancement data (1 byte) such as size designating data which designate character size. The text memory 42 stores data transferred from the line buffer 41. The line number memory 43 temporarily stores a line number N to be printed on the tape. The flag memory 44 stores flag data for character lines, i.e. a flush left flag LF, a centering flag CF, and a flush right flag, which are set when flush left, centering, and flush right are set respectively. The flag data are stored corresponding to character lines set with line enhancement. When a plurality of lines are printed, the maximum line length memory 45 stores data regarding the line with the maximum length. The character position memory 46 stores, along with code data and size designating data, data of character positions for each character of enhanced lines. The character buffer 47 stores character data of the plurality of characters for which dot pattern data was developed based on character position data, and other data, stored in the character position memory 46. A description is now provided of the manner in which a tape printing control routine is executed by the controller C of the tape printer 1, with reference to the flowcharts of FIGS. 11 through 14. In the figures, Si (i=1, 2, 3, . . . ) indicates a step. The following description assumes line enhancement is set for triple-line printing with each line set to the right-justification. Tape thus printed will appear as shown in FIG. 6.

Figure 11:
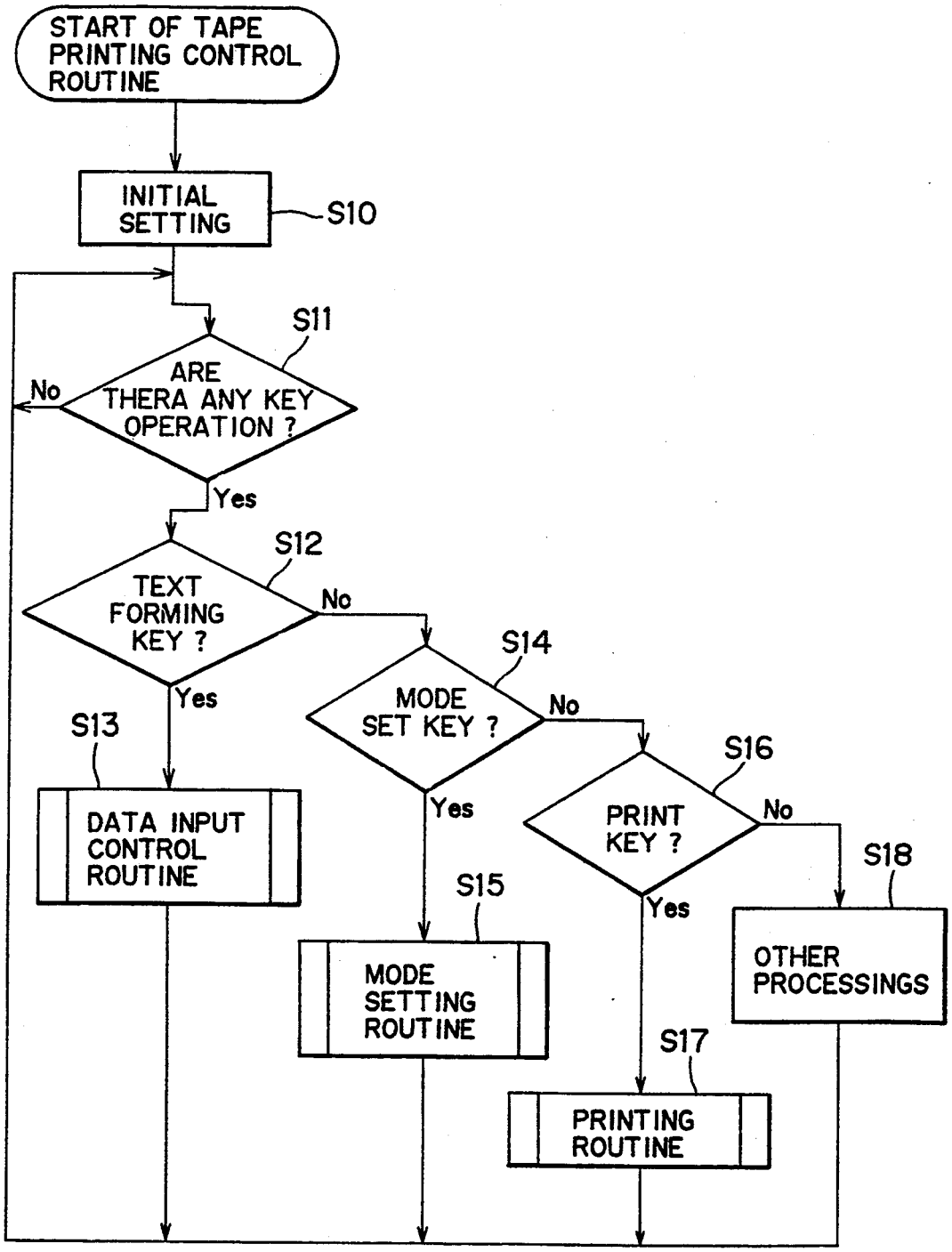
FIG. 11 is a flowchart outlining the tape printing control routine of the present invention.

Turning the power switch ON applies power to the tape printer 1 and starts the tape printing control routine shown in FIG. 11. Step S10 executes initial settings by clearing memories 41 through 47 and a line counter which designates the line to be printed. Operating the text forming key (i.e., steps S11 and S12 are "yes") initiates data input routine S13 in which data input through operations of character keys are processed.

Figure 12:
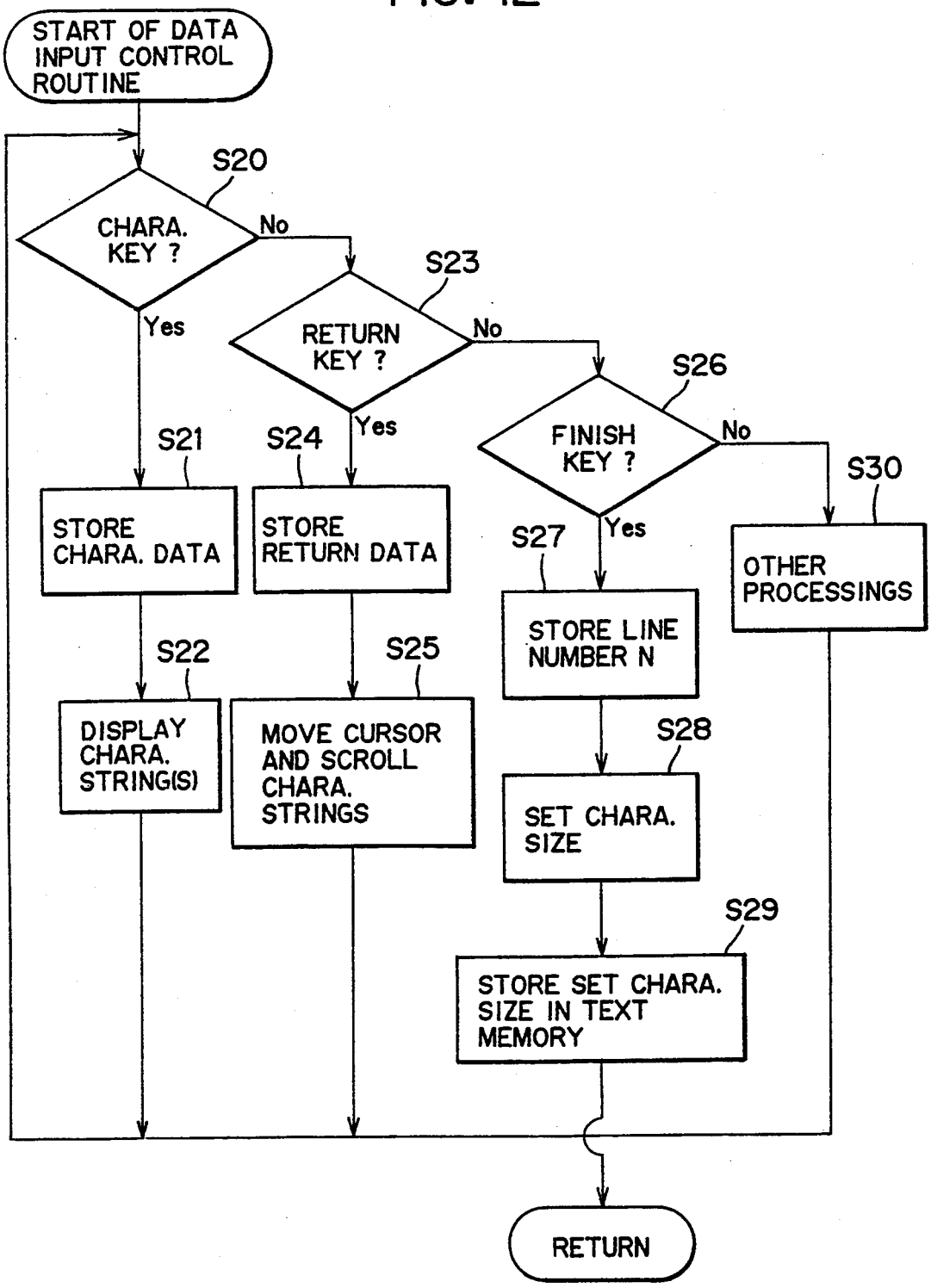
FIG. 12 is a flowchart outlining a data input processing subroutine of the present invention.
Figure 13:
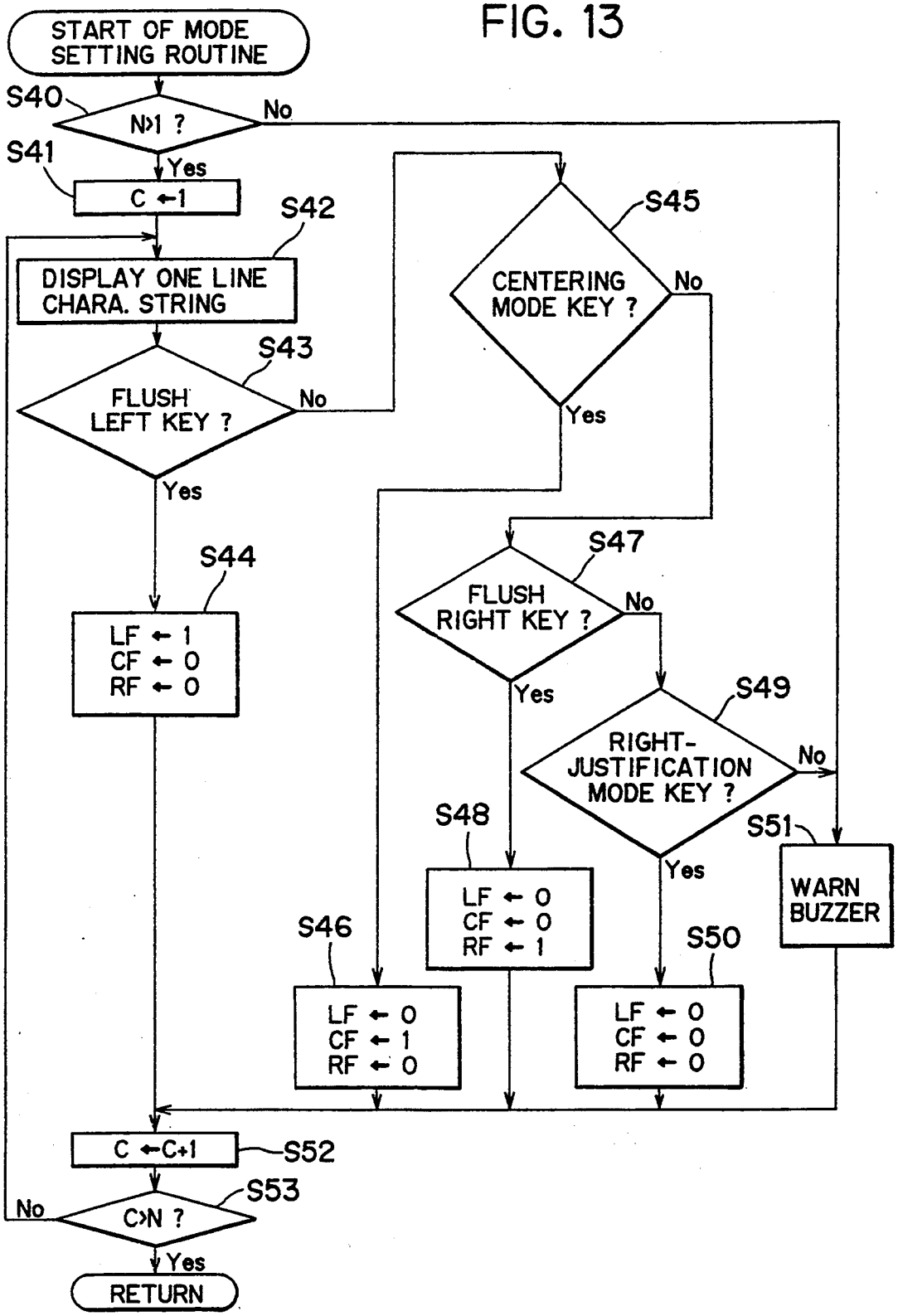
FIG. 13 is a flowchart outlining a mode setting control subroutine of the present invention.
Figure 14:
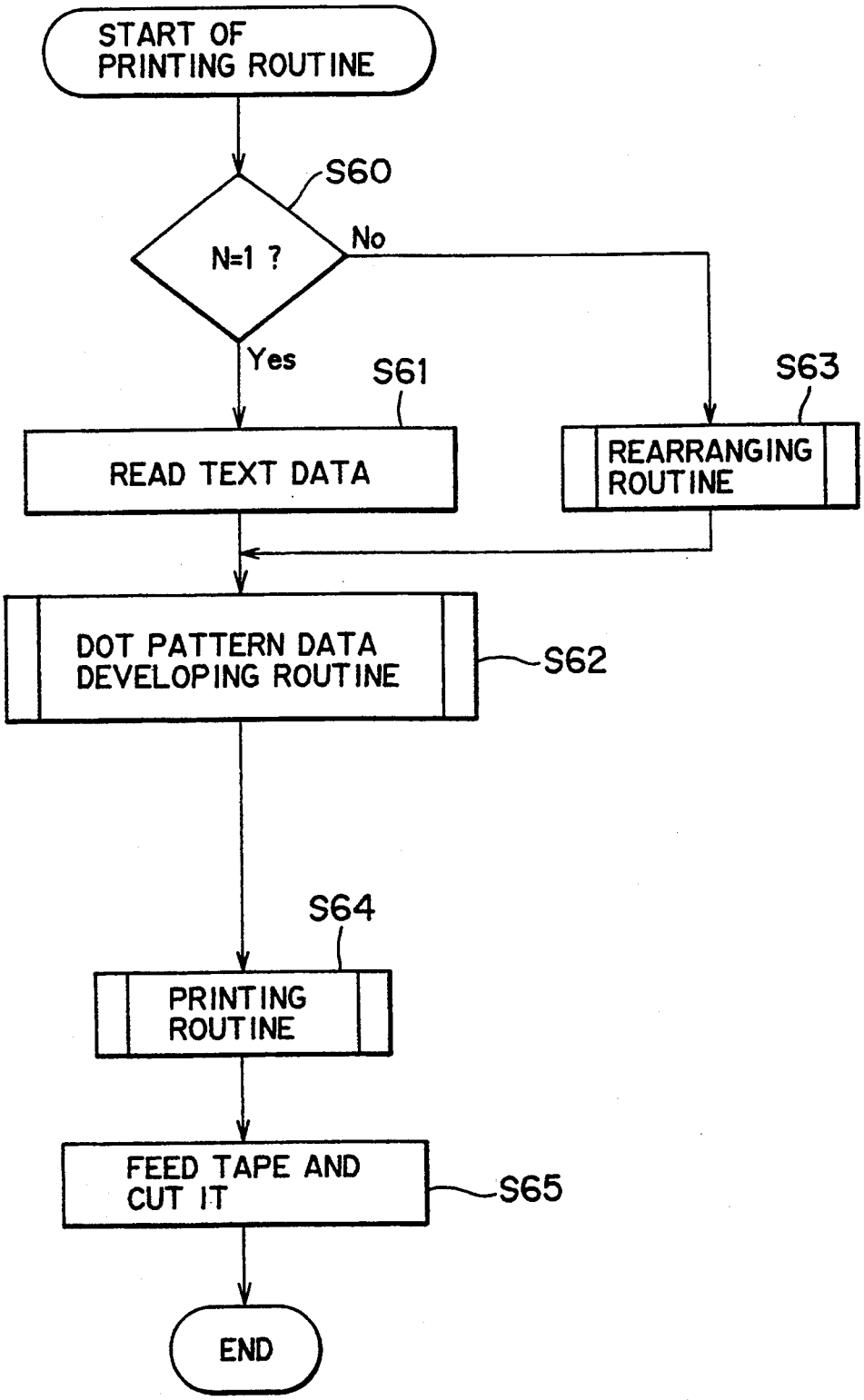
FIG. 14 is a flowchart outlining a print processing subroutine of the present invention.

A description of the data input control routine will be Given referring to FIG. 12. After start of the data input control routine, operating character keys (i.e., step S20 is "yes") causes, in step S21, the character code data for each character to be successively stored in the line buffer 41 and, in step S22, the characters to be displayed on the LCD 4. Using the example shown in FIG. 5, if character keys "A", "B", "C", "D", "E", "F", "G", "H", "I", "J", "K", "L", "M", and "N" are successively pressed in the stated order, a character string "ABCDEFGHIJKLMN" will appear on the LCD 4 at the first line. Pressing the return key (i.e., step S23 is "yes") Stores the fact that the return key was pressed once in the line buffer 41, and, in step S25, moves the curser to the far left of the second line of the LCD 4. Pressing successively the character keys "A", "B", "C", "D", "E", "F", and "G" to print the second line on the tape causes steps S20 through S22 to repeat and the character string "ABCDEFG" to appear at the second line of the LCD 4. To further print the character string "ABC" on the third line, the return key is again pressed. That the return key was again pressed will be stored in the line buffer in step S24. It is noted that the return key has been pressed twice so far in this embodiment. One line of the character string is scrolled and the cursor will move to left-hand side of the third line. Pressing the character keys "A", "B", and "C" causes steps S20 through S22 to repeat again and the character string "ABC" to appear on the third line of the LCD 4.

When the finish key is pressed after completing the above character input operations (i.e., steps S20 and S23 are "no" and step S26 is "yes"), a line number N to be printed on the tape is determined based on the number of times the return key was pressed by referring to the data stored in the lane buffer 41. The resultant line number N is stored in the line number memory 43 in step S27. For example, if the return key was pressed once, the line number N would be two. In this embodiment the return key was pressed twice, so the line number N is three. In step S28 the size of the characters at time of printing is set based on the line number N. Because in this embodiment the number of lines is three for triple-line printing, size designating data for small characters are read from the table stored in the ROM 31 and stored in the line buffer 41 in association with the character code data of each character stored therein. Thereafter, in step S29 the data in the line buffer 41 are transferred to the text memory 42.

Operating a mode set key (i.e., steps S11 and S14 are "yes" and step S12 is "no") initiates, in step S15, the mode setting routine for carrying out line enhancement. The mode setting routine will be described while referring to FIG. 13.

After the start of the mode setting routine, it is determined in step S40 whether the number of lines N is greater than two based on the data stored in the line number memory 43. If the number of lines is determined over two (i.e., step S40 is "yes"), the line counter is set to "1" to designate the first line as the object of the line enhancement. In step S42 the LCD 4 displays the character string on the first line. Operating the flush left mode key (i.e., step S43 is "yes") sets, in step S44, the flush left flag LF and resets both the centering mode flag CF and the flush right mode flag RF. Operating the centering mode key (i.e., step S43 is "no" and step S45 is "yes") sets, in step S46, the centering mode flag CF and resets both the flush left mode flag LF and the flush right mode flag RF. Further, operating the flush right mode key (i.e., steps S43 and S45 are "no" and S47 is "yes") sets, in step S48, the flush right mode flag RF and resets both the flush left mode flag LF and the centering mode flag CF. Operating the right-justification mode key (i.e., steps S43, S45, and S47 are "no" and step S49 is "yes") resets, in step S50, the flush left mode flag LF, the centering mode flag CF, and the flush right mode flag RF. Because in this embodiment the right-justification mode is selected, the flush left mode flag LF, the centering mode flag CF, and the flush right mode flag RS are reset and flag data corresponding to each line are stored in the flag memory 44.

When the line enhancement for the first line is set, the count number in the line counter is incremented in step S52. In step S53, whether the value of the line counter is over four is determined. If not (i.e., step S53 is "no") the routine returns to step S42. Because the line enhancement for the first line was just set, the value of the counter C is not greater than four so the routine returns to step S42 and line enhancement for the second and third lines are set. When line enhancements are set for all lines (i.e., step S53 is "yes") the routine returns to step S11. If, An step S40, the line number N is determined as one, or if a key other than the flush left mode key, the centering mode key, the flush right mode key and the right-justification mode key (i.e., steps S43, S45, S47, and S49 are "no") are pressed, the warning buzzer 20 goes off in step S51.

Pressing the print key (i.e., steps S11 and S16 are "yes" and steps S12 and S14 are "no") initiates the printing routine in step S17. The printing routine will be described while referring to FIG. 14. When the printing routine starts, it is determined in step 60 whether or not the line number N is one (1) based on data in the line number memory 43. If the line number N equals one (i.e., step S60 is "yes"), dot pattern data for those characters to be printed on the line are developed in the print buffer 47 in step S62 based on character code data and size designating data stored in the text memory 42. On the other hand, if the number of lines N is two or more (i.e., when Step S60 is "no"), a rearranging routine is executed in step S63 for developing dot pattern data in the print buffer based on the line enhancement set for each character for each line.

The rearranging routine will be described while referring to FIG. 15. When the rearranging routine is initiated, the longest line is determined by comparing the number of characters in each line. In step S70 the line number of the longest line is stored in the longest line memory 45. Because in this embodiment the longest line is the first line, "1" is stored in the longest line memory 45. To designate the first line, the line counter is set to "1" in step S71. In step S72 data for the first line are read from the text memory 42. In step S73 the value in the line counter and the data stored in the longest line memory 45 are compared to determine whether the first line is the longest. If, based on data of the line number N in the line number memory 43 and data stored in the longest line memory 45, the first line is determined as the longest (i.e., step S73 is "yes"), based on the size designating data and character code data stored in the text memory 42 about each character in the first line, the position for each character of the first line is calculated for developing dot pattern data in the print buffer 47. In step S74 the calculated results are stored, along with the size designating data and the character code data, in the character position memory 46 as character position data. Because in this embodiment the first line is the longest line, a standard position $P_n$, for example, the origin O of the print buffer 47 as shown in FIG. 16, is calculated for each character of the character string "ABCDEFGHIJKLMN" in the first line as a standard for the printing buffer 47 to develop dot pattern data. The results of this calculation are stored with the size designating data and the code data in the character position memory 46 as character position data.

In step S82, one is added to the value of the line counter C. In step S83, whether the value of the line counter C is greater than four is determined. At this point in this embodiment, because the routine was completed for the first line only, the value of the line counter C is less than four, so the routine proceeds to step S72 where the data for the second line is read. In step S73, whether the second line is the longest is determined by comparing the value in the counter C and the data in the longest line memory 45. In this embodiment the second line is not the longest line (i.e., step S73 is "no"). The line enhancement for the second line is determined based on the flag data stored in the flag memory 44. In this embodiment the second line is set for right-justification (as are the first and third), (i.e., steps S75, S77, and S79 are "no"). To print each character of the character string "ABCDEFG" of the second line with right-justification based on the length of the longest character string, that is, the character string "ABCDEFGHIJKLMN" of the first line, a standard position $P_n$ is calculated, based on the results of the above calculations, for each character of the character string to develop dot pattern data for the character buffer 47. In step S81 the calculated results are stored, along with the size designating data and character code data, in the character position memory 46 as character position data. The routine then proceeds to step S82. Steps S83 and S72 through S81 are executed for the third line as they were the second line. After the routine is completed for all lines, in step S83 the value of the counter C will be greater than that of the line number N (i.e., step S83 is "yes") and the routine returns to step S62. If any line had been set with the flush left mode line enhancement (i.e., step S75 is "yes") step 76 of the routine would be executed. Similarly, if any line had been set with either the centering or flush right mode line enhancement (i.e., step S78 or S80 respectively is "yes") step S78 and S80 respectively would be executed.

Figure 15:
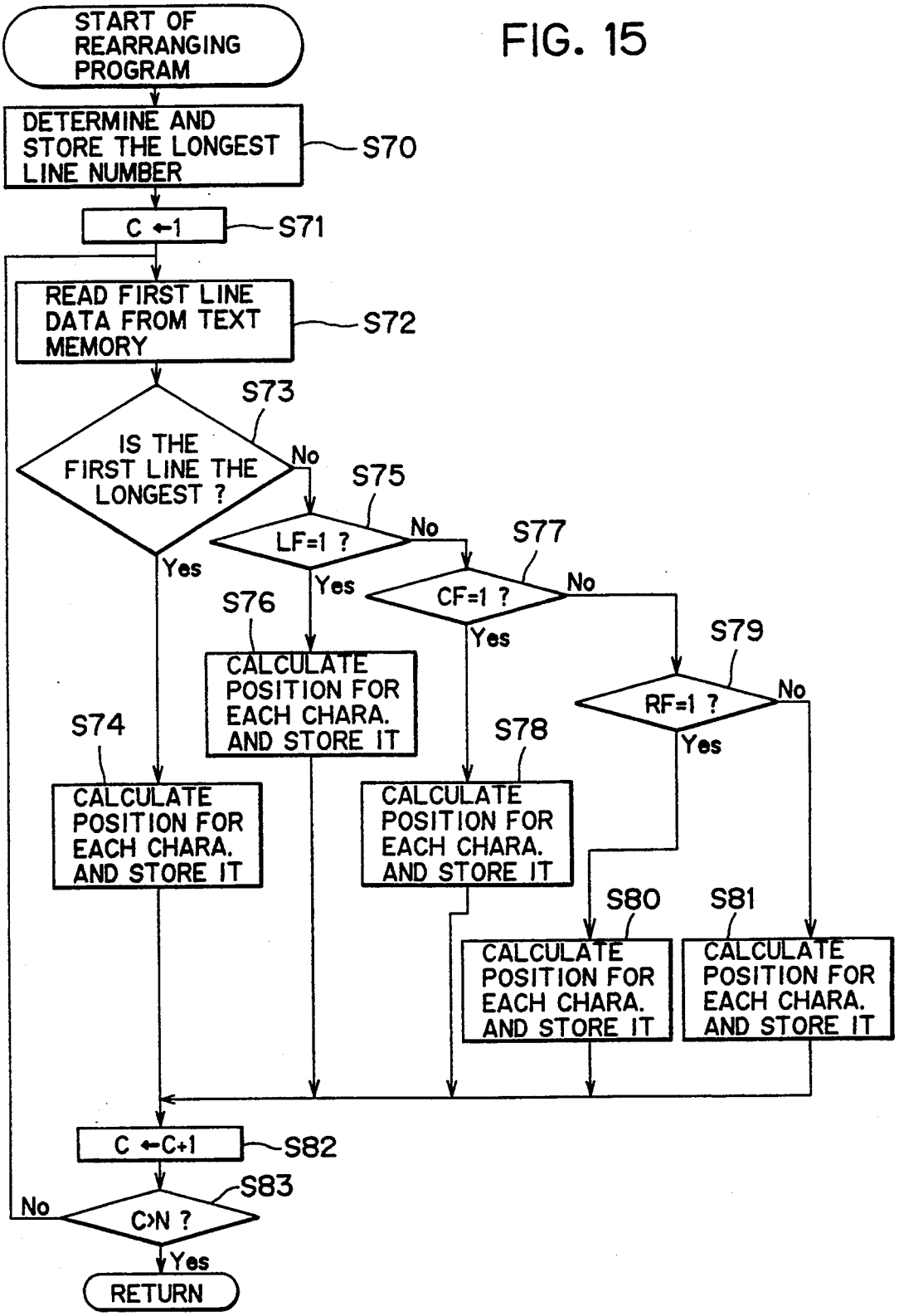
FIG. 15 is a flowchart outlining a rearranging processing subroutine of the present invention.
Figure 16:
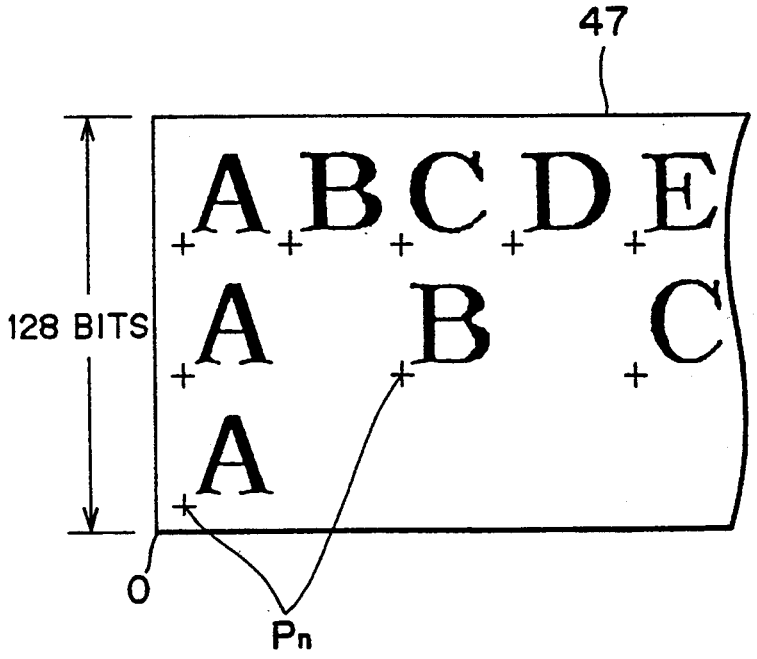
FIG. 16 is a schematic diagram showing dot pattern data in a print buffer of the embodiment of the present invention.

In step S62 the character print buffer 47 develops the dot pattern data for each character as shown in FIG. 15 based on the character position data for each character of each line, the size designating data, and the character code data stored in the character position memory 46.

When the character print buffer 47 develops dot pattern data for all characters, the tape feed motor 24 rotates, driving the bonding roller 12 and the take-up spool 9 in synchronism in their respective directions while the heating element is being heated to form characters on the printing tape 5 based on the data stored in the character print buffer 47. This causes a plurality of dot columns (dot strings) to be printed on the printing tape 5 to form characters thereon. In step S64 double-sided adhesive tape 10 is adhered to the printing tape 5. Lastly, after all characters have been printed, in step S65 a predetermined amount of tape is fed and cut and the routine returns to step S11.

By operating the flush left mode key, the centering mode key, the flush right mode key, or the right-justification mode key, line enhancement can be easily set for each character print line, which increases flexibility in laying out text to be printed, aesthetic quality of printed lines, and practicality of the tape printer.

While the invention has been described in detail with reference to specific embodiments thereof, it would be apparent to those skilled in the art that various changes and modifications may be made therein without departing from the spirit of the invention. For example, this embodiment described a tape printer which could print three lines of characters on a single tape. However, a tape printer which could print four lines or more is also possible.

Also, addition of a separate character generator ROM with outline data for each character instead of dot pattern data would allow printing of contour style characters.

Further, setting character sizes or styles other than those mentioned in this embodiments would be possible. By addition of character size key that, when operated allows selection of the desired character size and style.

What is claimed is:

1. A printer, comprising:

printing means for printing strings of characters on a tape-like print medium;

input means for entering commands regarding strings of characters to be printed on the tape-like print medium, said input means producing character code data representative of each character to be printed;

storage means for storing the character code data produced from said input means;

mode setting means for setting a line enhancement to each of a plurality of lines on a line basis, the line enhancement being one of flush left, centering, flush right, and justification;

determining means for determining, when at least one of the plurality of lines is set to the line enhancement by said mode setting means, a string of characters that is longest in length based on the character code data stored in said storage means; cutting means for cutting the tape-like medium; and control means for controlling said printing means to print the characters in a plurality of lines, the enhanced lines being printed as a function of the longest string of characters and for controlling said cutting means to cut the tape-like medium as a function of the longest string of characters.

2. The printer according to claim 1, wherein said input means further enters data regarding a number of print lines in which the strings of characters are printed and said control means investigates the number of print lines based on the data entered from said input means.

3. The printer according to claim 2, wherein said mode setting means sets the line enhancement only when the print line number investigated by said control means indicates two or more lines.

4. The printer according to claim 2, further comprising a first memory means storing the print line number investigated by said control means.

5. The printer according to claim 4, further comprising a second memory storing a table indicating a relationship between numbers of print lines to be printed on the tape-like print medium and size designating data representative of a size of character to be printed on the tape-like print medium.

6. The printer according to claim 5, wherein said control means selects the size designating data corresponding to the print line number stored in said first memory referring to the table in said second memory.

7. The printer according to claim 6, wherein said storage means further stores the size designating data selected by said control means in said storage means in association with the character code data.

8. The printer according to claim 1, wherein said storage means further stores character enhancement data representative of the character enhancement set by said mode setting means.

9. The printer according to claim 1, further comprising a third memory for storing data regarding the line with the longest length.

10. The printer according to claim 1, further comprising display means for displaying the strings of characters entered from said input means.

11. A printer, comprising:

a frame;

means for accommodating a tape-like print medium;

means for uni-directionally moving the tape-like print medium;

printing means fixedly mounted on said frame for printing strings of characters on the tape-like print medium moving past said printing means, a segment of the tape-like print medium on which the strings of characters are printed having an end determined depending on a number of characters contained in the strings of characters;

input means for entering commands regarding strings of characters to be printed on the tape-like print medium and a print line number in which the strings of characters are printed as a plurality of print lines, said input means producing character code data representative of each character to be printed and line number data representative of the print line number;

storage means for storing the character code data and the line number data both produced from said input means;

mode setting means for setting a line enhancement to each of the plurality of print lines on a line basis, the line enhancement being one of flush left, centering, flush right, and justification;

determining means for determining, when at least one of the plurality of print lines is set to the line enhancement by said mode setting means, a string of characters that is longest in length based on the character code data and the line number data stored in said storage means; cutting means for cutting the segment of tape-like medium; and control means for controlling said printing means to print the characters in a plurality of lines based on the character code data and the line number data, the enhanced lines being printed as a function of the longest string of characters, and for controlling the cutting of the segment.

12. The printer according to claim 11, wherein said control means investigates a print line number based on the line number data.

13. The printer according to claim 12, wherein said mode setting means sets the line enhancement only when the print line number investigated by said control means indicates two or more than lines.

14. The printer according to claim 12, further comprising a first memory means storing the print lane number investigated by said control means.

15. The printer according to claim 14, further comprising a second memory storing a table indicating a relationship between numbers of print lines to be printed on the tape-like print medium and size designating data representative of a size of characters to be printed on the tape-like print medium.

16. The printer according to claim 15, wherein said control means selects the size designating data corresponding to the print line number stored in said first memory referring to the table in said second memory.

17. The printer according to claim 16, wherein said storage means further stores the size designating data selected by said control means in said storage means in association with the character code data.

18. The printer according to claim 11, wherein said storage means further stores character enhancement data representative of the character enhancement set by said mode setting means.

19. The printer according to claim 11, further comprising a third memory for storing data regarding the line with the longest length.

20. The printer according to claim 11, further comprising display means for displaying the strings of characters entered from said input means.

* * * * *